US010657894B2

(12) United States Patent
Peng et al.

(10) Patent No.: US 10,657,894 B2
(45) Date of Patent: May 19, 2020

(54) PIXEL CIRCUIT, METHOD FOR DRIVING THE SAME, DISPLAY PANEL, AND DISPLAY DEVICE

(71) Applicant: BOE Technology Group Co., Ltd., Beijing (CN)

(72) Inventors: Kuanjun Peng, Beijing (CN); Xiangxiang Zou, Beijing (CN); Chengchung Yang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/134,026

(22) Filed: Sep. 18, 2018

(65) Prior Publication Data

US 2019/0096327 A1 Mar. 28, 2019

(30) Foreign Application Priority Data

Sep. 28, 2017 (CN) ..... 2017 1 0898165

(51) Int. Cl.
*G09G 3/3208* (2016.01)
*G09G 3/3241* (2016.01)
*G09G 3/3233* (2016.01)

(52) U.S. Cl.
CPC ..... *G09G 3/3241* (2013.01); *G09G 3/3233* (2013.01); *G09G 2300/043* (2013.01); *G09G 2300/0426* (2013.01); *G09G 2300/0819* (2013.01); *G09G 2300/0861* (2013.01); *G09G 2310/0251* (2013.01); *G09G 2310/0262* (2013.01); *G09G 2320/0233* (2013.01); *G09G 2320/0257* (2013.01)

(58) Field of Classification Search
CPC ..... G09G 3/3233
See application file for complete search history.

(56) References Cited

U.S. PATENT DOCUMENTS

2010/0164847 A1* 7/2010 Lee ..... G09G 3/3233 345/77
2012/0147060 A1 6/2012 Jeong
2018/0357962 A1 12/2018 Feng
2018/0374418 A1* 12/2018 Chen ..... G09G 3/3233

FOREIGN PATENT DOCUMENTS

CN 102568374 A 7/2012
CN 104658470 A 5/2015
CN 106067291 A 11/2016
CN 106097976 A 11/2016
CN 106531076 A 3/2017

OTHER PUBLICATIONS

Chinese Office Action for counterpart CN201710898165.9 dated Mar. 18, 2019.

* cited by examiner

*Primary Examiner* — Roy P Rabindranath
(74) *Attorney, Agent, or Firm* — Arent Fox LLP; Michael Fainberg

(57) ABSTRACT

Disclosed are a pixel circuit, a method for driving the same, a display panel, and a display device, and in the pixel circuit, a node reset sub-circuit resets a gate of a driver transistor in a first reset stage, a data writing sub-circuit writes a data signal, and compensates for drifting threshold voltage of the driver transistor, in a data writing stage, and a light-emission control sub-circuit connects a first voltage terminal with a light-emitting diode in a light emission stage.

15 Claims, 17 Drawing Sheets

PIXEL CIRCUIT, METHOD FOR DRIVING THE SAME, DISPLAY PANEL, AND DISPLAY DEVICE

CROSS-REFERENCE TO RELATED APPLICATION

This application claims priority of Chinese Patent Application No. 201710898165.9, filed on Sep. 28, 2017, which is hereby incorporated by reference in its entirety.

FIELD

The present disclosure relates to the field of display technologies, and particularly to a pixel circuit, a method for driving the same, a display panel, and a display device.

BACKGROUND

An Organic Light-Emitting Diode (OLED) display is one of focuses in the field of researches on the existing flat panel displays, and the OLED display has advantages of low power consumption, a low product cost, self-luminescence, a wide angle of view, a high response speed, etc., over a liquid crystal display; and at present, the OLED display has come to take the place of the traditional Liquid Crystal Display (LCD) in the field of flat panel displays including mobile phones, PDAs, digital photos, etc., where the design of a pixel circuit is a core technology in the OLED display, and researches on its design are of great significance.

SUMMARY

An embodiment of the disclosure provides a pixel circuit including: a driver transistor, a data writing sub-circuit, a light-emission control sub-circuit, a node reset sub-circuit, and a light-emitting diode, wherein:

the node reset sub-circuit is configured to reset a gate of the driver transistor in response to a first scan signal terminal in a first reset stage;

the data writing sub-circuit is configured to write a data signal of a data signal terminal into the gate of the driver transistor, and to compensate threshold voltage of the driver transistor, in response to a second scan signal terminal in a data writing stage;

the light-emission control sub-circuit is configured to provide a first electrode of the driver transistor with a signal of a first voltage terminal in response to a first light-emission control terminal in the first reset stage and a light emission stage; and to connect a second electrode of the driver transistor with an anode of the light-emitting diode in response to a second light-emission control terminal in a light emission stage;

the driver transistor is configured to drive current according to the data signal to drive the light-emitting diode to emit light; and the first reset stage, the data writing stage, and the light emission stage are consecutive periods of time.

Optionally, in the pixel circuit above according to some embodiments of the disclosure, the node reset sub-circuit includes a first switch transistor, wherein:

the first switch transistor has a gate connected with the first scan signal terminal, a first electrode connected with a first reset signal terminal, and a second electrode connected with the gate of the driver transistor.

Optionally, in the pixel circuit above according to some embodiments of the disclosure, the data writing sub-circuit includes a second switch transistor, a third switch transistor, and a first capacitor, wherein:

the second switch transistor has a gate connected with the second scan signal terminal, a first electrode connected with the gate of the driver transistor, and a second electrode connected with the second electrode of the driver transistor;

the third switch transistor has a gate connected with the second scan signal terminal, a first electrode connected with the data signal terminal, and a second electrode connected with the first electrode of the driver transistor; and the first capacitor has one terminal connected with the gate of the driver transistor, and another terminal connected with the first voltage terminal.

Optionally, in the pixel circuit above according to some embodiments of the disclosure, the light-emission control sub-circuit includes a fourth switch transistor and a fifth switch transistor, wherein:

the fourth switch transistor has a gate connected with the first light-emission control terminal, a first electrode connected with the first voltage terminal, and a second electrode connected with the first electrode of the driver transistor; and the fifth switch transistor has a gate connected with the second light-emission control terminal, a first electrode connected with the first electrode of the driver transistor, and a second electrode connected with the anode of the light-emitting diode.

Optionally, in the pixel circuit above according to some embodiments of the disclosure, the pixel circuit further includes an anode reset sub-circuit, wherein:

the anode reset sub-circuit is configured to reset the anode of the light-emitting diode in response to a third scan signal terminal before the light emission stage.

Optionally, in the pixel circuit above according to some embodiments of the disclosure, the anode reset sub-circuit includes a sixth switch transistor, wherein:

the sixth switch transistor has a gate connected with the third scan signal terminal, a first electrode connected with the second reset signal terminal, and a second electrode with the anode of the light-emitting diode.

Optionally, in the pixel circuit above according to some embodiments of the disclosure, the third scan signal terminal and the first scan signal terminal are same terminal, or the third scan signal terminal and the second scan signal terminal are same terminal.

Optionally, in the pixel circuit above according to some embodiments of the disclosure, the first light-emission control terminal and the second light-emission control terminal are same signal terminal.

Optionally, in the pixel circuit above according to some embodiments of the disclosure, the node reset sub-circuit is further configured to reset the gate of the driver transistor in response to the first scan signal terminal in a second reset stage, wherein:

the second reset stage lies between the first reset stage and the data writing stage.

Correspondingly, an embodiment of the disclosure further provides a display panel including the pixel circuit according to any one of the embodiments above of the disclosure.

Correspondingly, an embodiment of the disclosure further provides a display device including the display panel according to the embodiment above of the disclosure.

Correspondingly, an embodiment of the disclosure further provides a method for driving the pixel circuit above, the method including:

in the first reset stage, resetting, by the node reset sub-circuit, the gate of the driver transistor under the control of the first scan terminal, and providing, by the light-emission control sub-circuit, the first electrode of the driver transistor with the signal of the first voltage terminal under the control of the first light-emission control terminal;

in the data writing stage, writing, by the data writing sub-circuit, the data signal of the data signal terminal into the gate of the driver transistor under the control of the second scan signal terminal, and compensating for the threshold voltage of the drive transistor; and in the light emission stage, providing, by the light-emission control sub-circuit, the first electrode of the driver transistor with the signal of the first voltage terminal under the control of the first light-emission control terminal, and connecting the second electrode of the driver transistor with the anode of the light-emitting diode under the control of the second light-emission control terminal; and driving, by the driver transistor, the light emitting diode to emit light.

Optionally, in the driving method above according to some embodiments of the disclosure, in response to that the pixel circuit includes an anode reset sub-circuit, the driving method further includes:

before the light emission stage, resetting, by the anode reset sub-circuit, the anode of the light emitting diode under the control of a third scan signal terminal.

Optionally, in the driving method above according to some embodiments of the disclosure, between the first reset stage and the data writing stage, the method further includes a second reset stage, wherein:

in the second reset stage, resetting, by the node reset sub-circuit, the gate of the driver transistor under the control of the first scan signal terminal.

Optionally, in the driving method above according to some embodiments of the disclosure, in response to that the third scan signal terminal and the first scan signal terminal are same terminal, between the first reset stage and the second reset stage, the method further includes: resetting, by the anode reset sub-circuit, the anode of the light-emitting diode under the control of the third scan signal terminal; and in response to that the third scan signal terminal and the second scan signal terminal are same terminal, in the data writing stage, the method further includes: resetting, by the anode reset sub-circuit, the anode of the light-emitting diode under the control of the third scan signal terminal.

Optionally, in the driving method above according to some embodiments of the disclosure, in response to that the first light-emission control terminal and the second light-emission control terminal are same signal terminal, in the first reset stage, the method further includes:

connecting, by the light-emission control sub-circuit, the second electrode of the driver transistor with the anode of the light-emitting diode under the control of the second light-emission control terminal.

DETAILED DESCRIPTION OF THE EMBODIMENTS

Figure 1A:
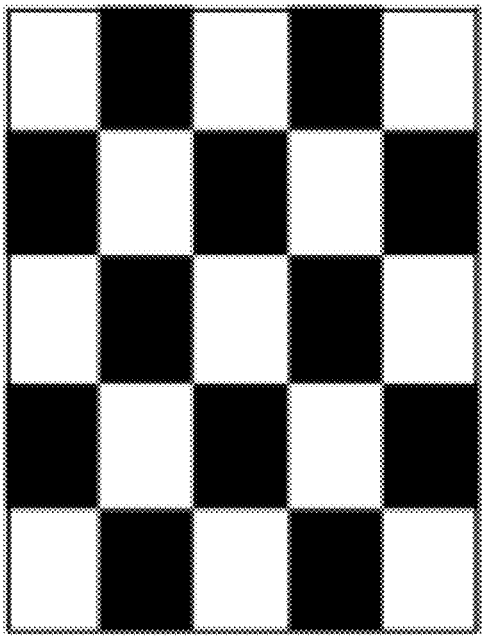
FIG. 1A to FIG. 1C are schematic diagrams of the images displayed at the different grayscales in the pixel circuits in the related art.

In order to make the objects, technical solutions, and advantages of the disclosure more apparent, particular implementations of the pixel circuit, the method for driving the same, the display panel, and the display device according to the embodiments of the disclosure will be described below in details with reference to the drawings. It shall be appreciated that the preferable embodiments to be described below are merely intended to illustrate and explain the disclosure, but not to limit the disclosure thereto, and the embodiments of the disclosure, and the features in the embodiments can be combined with each other unless they conflict with each other.

The shapes and sizes of respective components in the drawings are not intended to reflect any real proportion, but only intended to illustrate the disclosure of the disclosure.

Figure 1B:
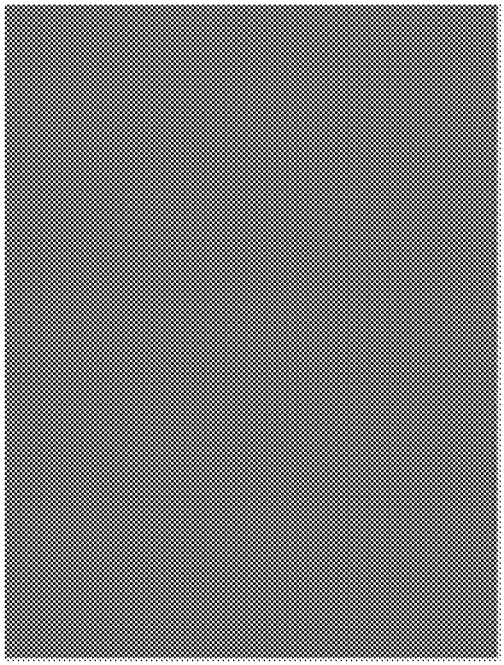
Figure 1C:
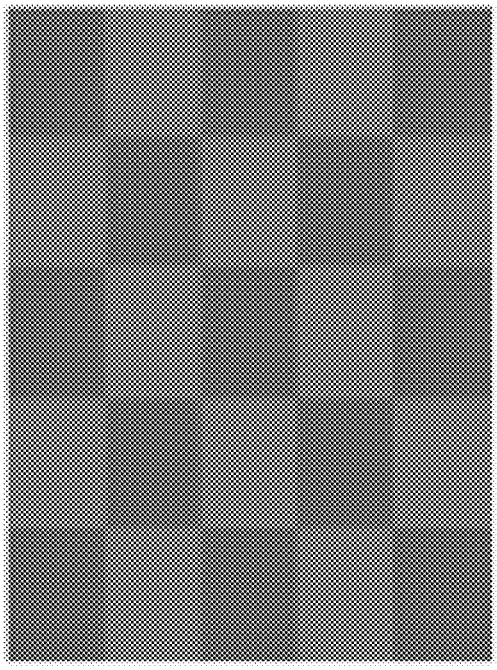

An afterimage tends to occur on a display panel including the existing pixel circuits, and as illustrated in FIG. 1A, after an image has been displayed at both high and low grayscales for a period of time, if the image is to be switched to a grayscale image at the same grayscale as illustrated in FIG. 1B, then I-V curves of gate-source voltage Vgs in driver transistors of the pixel circuit in positive and negative scanning may not overlap with each other. For example, when the image is switched from the grayscale L255 to the grayscale L128, and when the image is switched from the grayscale L0 to the grayscale L128, the gate-source voltage Vgs of the driver transistors is changed in different directions, and thus drive current is different, so that an afterimage may occur due to different brightness at pixels as illustrated in FIG. 1C, and the image as illustrated in FIG. 1B e will not be displayed until the afterimage has been displayed for a period of time.

Figure 2:
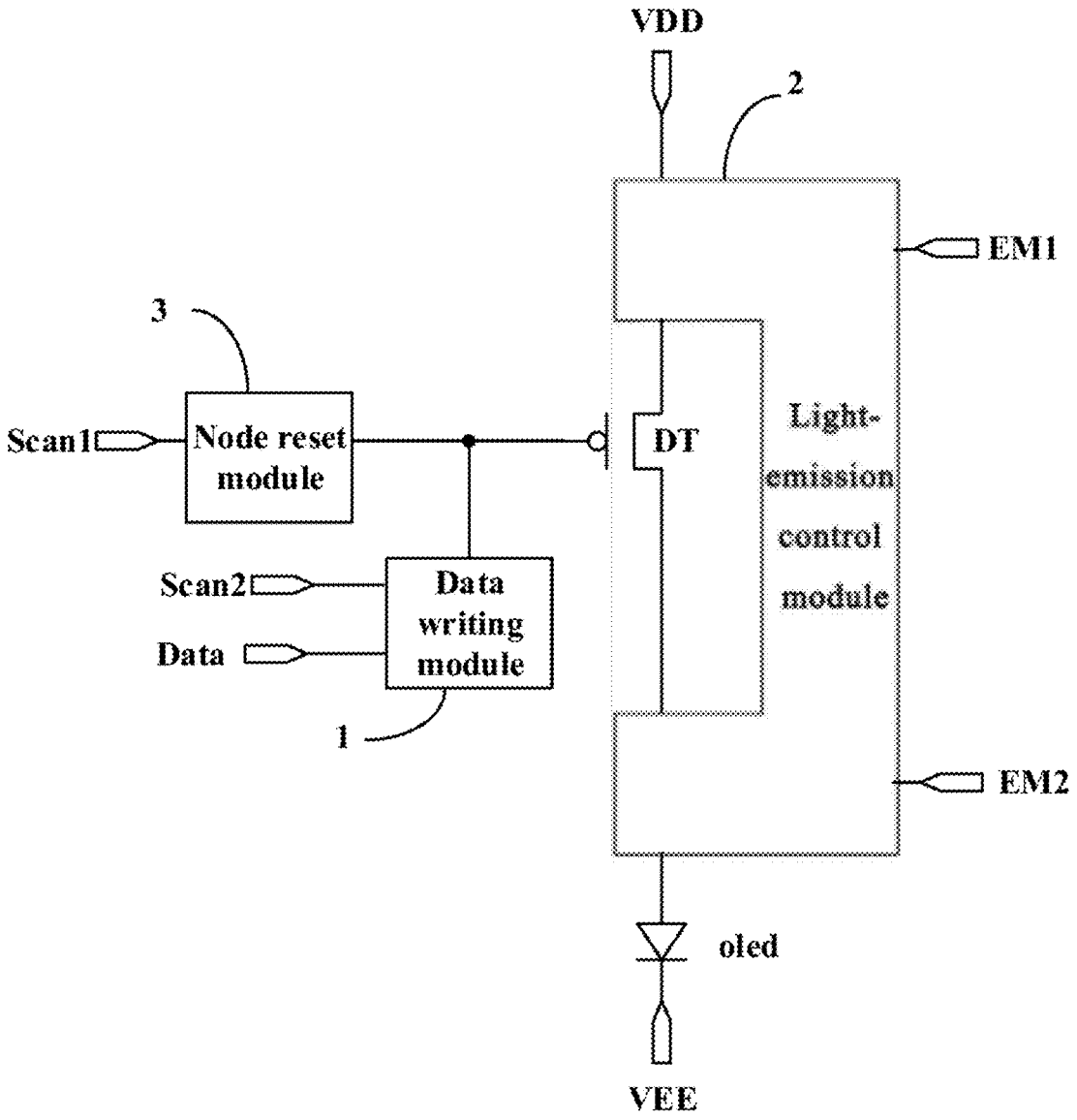
FIG. 2 is a first schematic structural diagram of a pixel circuit according to some embodiments of the disclosure.

As illustrated in FIG. 2, a pixel circuit according to an embodiment of the disclosure includes a driver transistor DT, a data writing sub-circuit 1, a light-emission control sub-circuit 2, a node reset sub-circuit 3, and a light-emitting diode oled.

The node reset sub-circuit 3 is configured to reset a gate of the driver transistor DT in response to a first scan signal terminal Sacn1 in a first reset stage.

The data writing sub-circuit 1 is configured to write a data signal of a data signal terminal Data into the gate of the driver transistor DT, and to compensate threshold voltage of the driver transistor DT, in response to a second scan signal terminal Scan2 in a data writing stage.

The light-emission control sub-circuit 2 is configured to provide a first electrode of the driver transistor DT with a signal of a first voltage terminal VDD in response to a first light-emission control terminal EM1 in the first reset stage and a light emission stage; and to connect a second electrode of the driver transistor DT with an anode of the light-emitting diode oled in response to a second light-emission control terminal EM2 in a light emission stage P3.

The driver transistor DT is configured to drive current according to the data signal to drive the light-emitting diode oled to emit light.

The first reset stage, the data writing stage, and the light emission stage are consecutive periods of time.

In the pixel circuit above according to some embodiments of the disclosure, the node reset sub-circuit resets the gate of the driver transistor in the first reset stage, the data writing sub-circuit writes the data signal, and compensates for the drifting threshold voltage of the driver transistor, in the data writing stage, and the light-emission control sub-circuit connects the first voltage terminal with the light-emitting diode in the light emission stage, thus addressing the problem of display non-uniformity arising from the drifting threshold voltage of the driver transistor due to a process factor, and aging of the transistor, through internal compensation. Furthermore the light-emission control sub-circuit resets the first electrode of the driver transistor using the first voltage terminal in the first reset stage, and the reset sub-circuit resets the gate of the driver transistor in the first reset stage, so that gate-source voltage Vgs of the driver transistor can be a constant value without being affected by a last signal or image, thus addressing the problem of an afterimage.

Optionally, in the pixel circuit according to some embodiments of the disclosure, as illustrated in FIG. 2, a cathode of the light-emitting diode oled is connected with a second voltage terminal VEE, and the voltage of the second voltage terminal VEE is typically negative voltage or ground.

The disclosure will be described below in details in connection with a particular embodiment thereof. It shall be noted that this embodiment is intended to better illustrate the disclosure, but not to limit the disclosure thereto.

Figure 4:
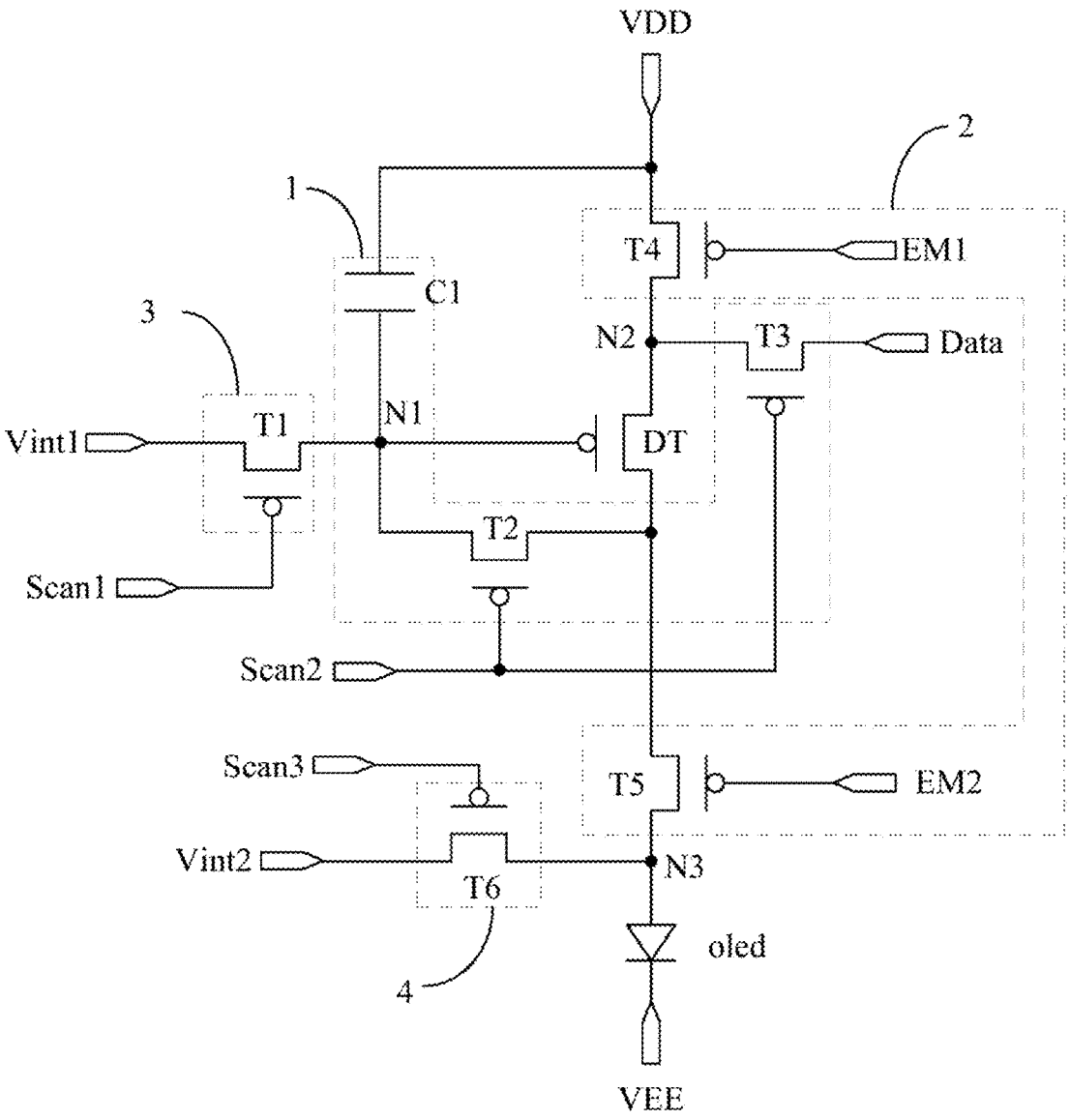
FIG. 4 is a third schematic structural diagram of the pixel circuit according to some embodiments of the disclosure.

Optionally, in the pixel circuit according to some embodiments of the disclosure, as illustrated in FIG. 4, the node reset sub-circuit 3 includes a first switch transistor T1.

The first switch transistor T1 has a gate connected with the first scan signal terminal Scan1, a first electrode connected with a first reset signal terminal Vint1, and a second electrode connected with the gate of the driver transistor DT.

Optionally, in the first reset stage, when the first switch transistor T1 is switched on under the control of the first scan signal terminal Scan1, it provides the gate of the driver transistor DT with a signal of the first reset signal terminal Vint1 to thereby reset the gate of the driver transistor DT.

The particular structure of the node reset sub-circuit in the pixel circuit has been described only by way of an example, and will not be limited thereto in a particular implementation, but can be another structure which can occur to those skilled in the art, although the embodiment of the disclosure will not be limited thereto.

Optionally, in the pixel circuit according to some embodiment of the disclosure, as illustrated in FIG. 4, the data writing sub-circuit 1 includes a second switch transistor T2, a third switch transistor T3, and a first capacitor C1.

The second switch transistor T2 has a gate connected with the second scan signal terminal Scan2, a first electrode connected with the gate of the driver transistor DT, and a second electrode connected with the second electrode of the driver transistor DT.

The third switch transistor T3 has a gate connected with the second scan signal terminal Scan2, a first electrode connected with the data signal terminal Data, and a second electrode connected with the first electrode of the driver transistor DT.

The first capacitor C1 has one terminal connected with the gate of the driver transistor DT, and another terminal connected with the first voltage terminal VDD.

Optionally, in the data writing stage, the third switch transistor T3 is switched on under the control of the second scan signal terminal Scan2, and provides the first electrode of the driver transistor DT with the data signal of the data signal terminal Data, and the second switch transistor T2 is switched on so that the driver transistor DT constitutes a diode structure, and the first capacitor C1 starts being charged to Vdata-|Vth| to drive the driver transistor DT to be switched off, so the data signal, and the threshold voltage Vth of the driver transistor DT is written into the gate of the driver transistor DT.

The particular structure of the data writing sub-circuit in the pixel circuit has been described only by way of an example, and will not be limited thereto in a particular implementation, but can be another structure which can occur to those skilled in the art, although the embodiment of the disclosure will not be limited thereto.

Optionally, in the pixel circuit according to some embodiments of the disclosure, as illustrated in FIG. 4, the light-emission control sub-circuit 2 includes a fourth switch transistor T4 and a fifth switch transistor T5.

The fourth switch transistor T4 has a gate connected with the first light-emission control terminal EM1, a first electrode connected with the first voltage terminal VDD, and a second electrode connected with the first electrode of the driver transistor DT.

The fifth switch transistor T5 has a gate connected with the second light-emission control terminal EM2, a first electrode connected with the first electrode of the driver transistor DT, and a second electrode connected with the anode of the light-emitting diode oled.

Optionally, in the first reset stage, the fourth switch transistor T4 is switched on under the control of the first light-emission control terminal EM1, and provides the first electrode of the driver transistor DT with the signal of the first voltage terminal VDD to thereby reset the first electrode of the driver transistor DT.

In the light emission stage, the fourth switch transistor T4 is switched on under the control of the first light-emission control terminal EM1, the fifth switch transistor T5 is switched on under the control of the second light-emission control terminal EM2, and the signal of the first voltage terminal VDD is connected with the light-emitting diode oled through the driver transistor DT, so that the light-emitting diode oled is driven by the driver transistor DT to emit light.

The particular structure of the light-emission control sub-circuit in the pixel circuit has been described only by way of an example, and will not be limited thereto in a particular implementation, but can be another structure which can occur to those skilled in the art, although the embodiment of the disclosure will not be limited thereto.

Figure 3:
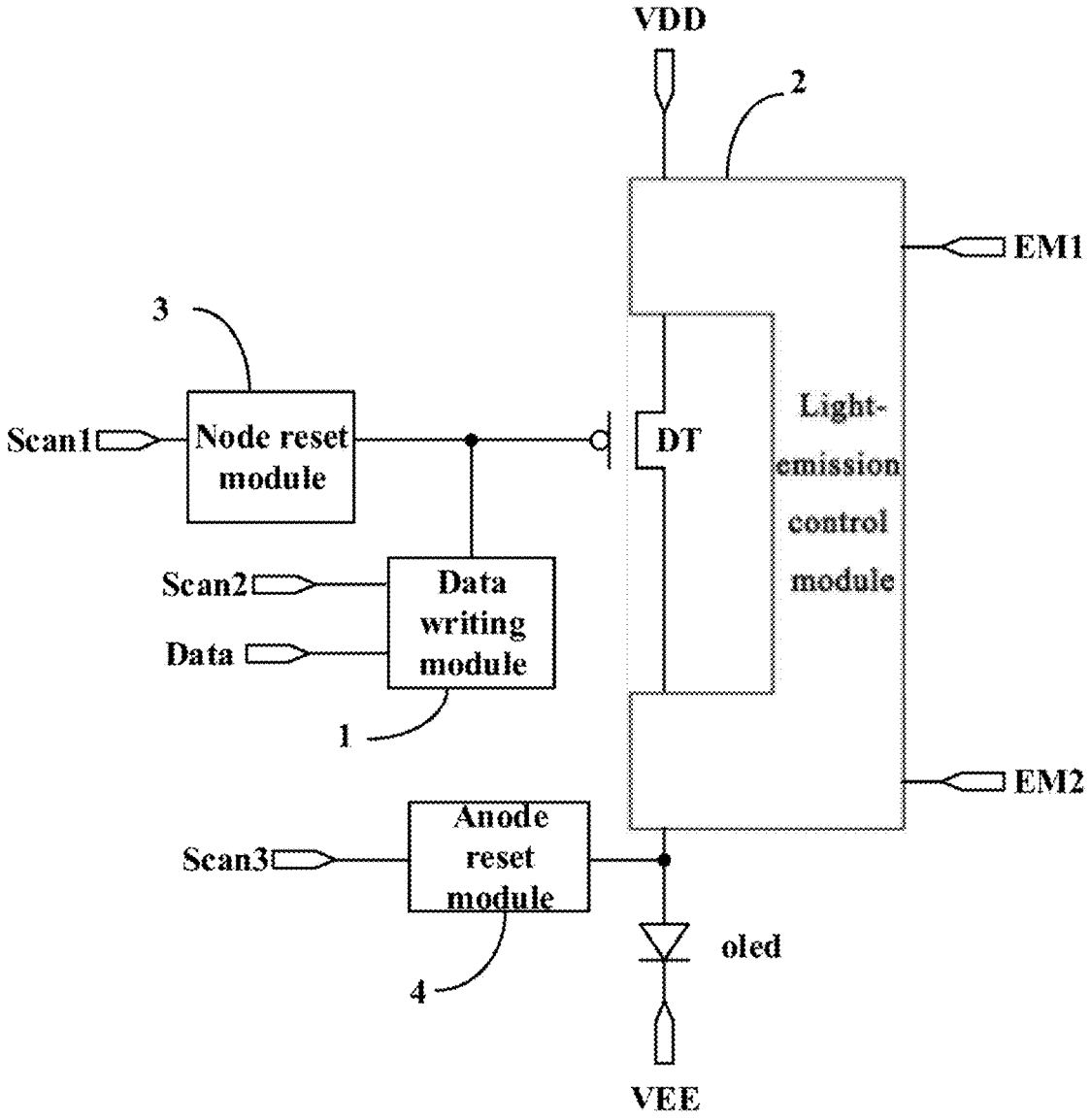
FIG. 3 is a second schematic structural diagram of the pixel circuit according to some embodiments of the disclosure.

Optionally, in the pixel circuit according to the embodiment of the disclosure, as illustrated in FIG. 3, the pixel circuit further includes an anode reset sub-circuit 4.

The anode reset sub-circuit 4 is configured to reset the anode of the light-emitting diode oled in response to a third scan signal terminal Scan3 before the light emission stage, so that the light-emitting diode oled can emit light in the current frame without being affected by voltage of light emission in a previous frame.

Optionally, in the pixel circuit according to the embodiment of the disclosure, as illustrated in FIG. 4, the anode reset sub-circuit 4 includes a sixth switch transistor T6.

The sixth switch transistor T6 has a gate connected with the third scan signal terminal Scan3, a first electrode connected with the second reset signal terminal Vint2, and a second electrode with the anode of the light-emitting diode oled.

Optionally, before the light emission stage, the sixth switch transistor T6 is switched on under the control of the third scan signal terminal Scan3, and provides the light-emitting diode oled with the second reset signal terminal Vint2 to thereby reset the anode of the light-emitting diode oled.

The particular structure of the anode reset sub-circuit in the pixel circuit has been described only by way of an example, and will not be limited thereto in a particular implementation, but can be another structure which can occur to those skilled in the art, although the embodiment of the disclosure will not be limited thereto.

Figure 5:
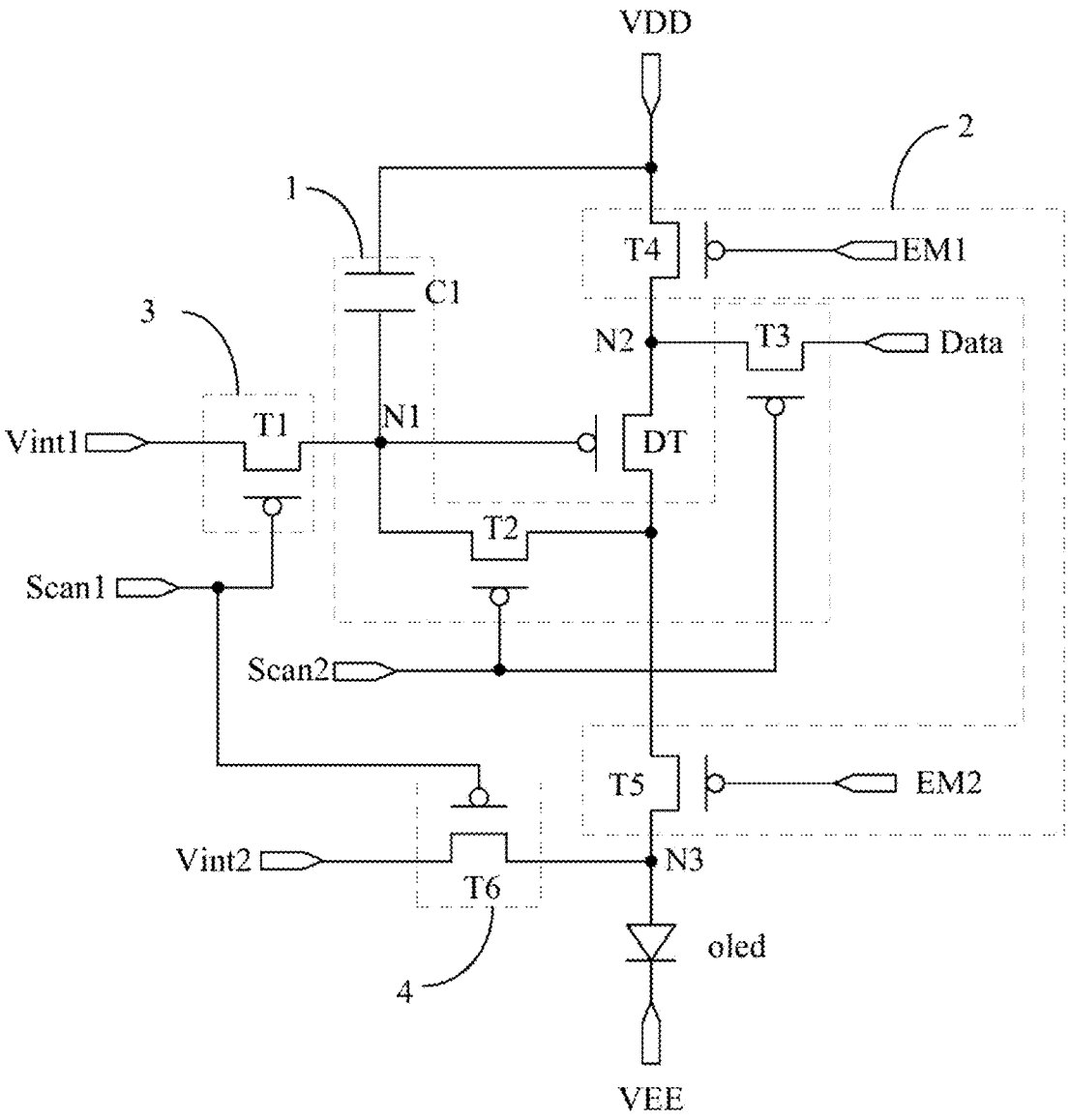
FIG. 5 is a fourth schematic structural diagram of the pixel circuit according to some embodiments of the disclosure.

Optionally, in the pixel circuit according to some embodiments of the disclosure, as illustrated in FIG. 5, the third scan signal terminal Scan3 is the same terminal as the first scan signal terminal Scan1, that is, the anode reset sub-circuit responds to the first scan signal terminal Scan1, so that a signal terminal can be dispensed with to thereby reduce the amount of wiring.

Figure 6:
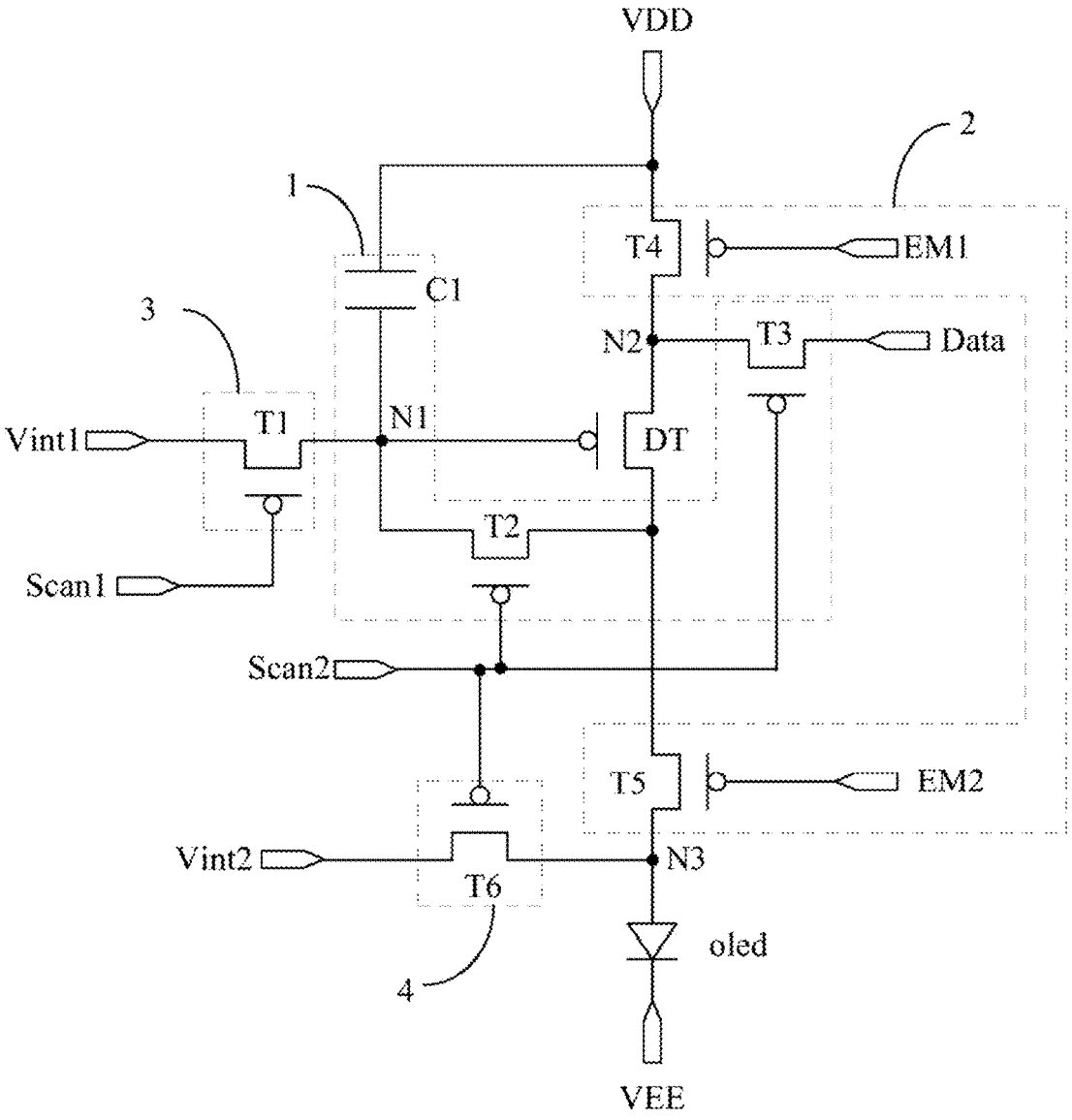
FIG. 6 is a fifth schematic structural diagram of the pixel circuit according to some embodiments of the disclosure.

Optionally, in the pixel circuit according to some embodiments of the disclosure, as illustrated in FIG. 6, the third scan signal terminal Scan3 is the same terminal as the second scan signal terminal Scan2, that is, the anode reset sub-circuit responds to the second scan signal terminal Scan2, so that a signal terminal can be dispensed with to thereby reduce the amount of wiring.

Figure 7:
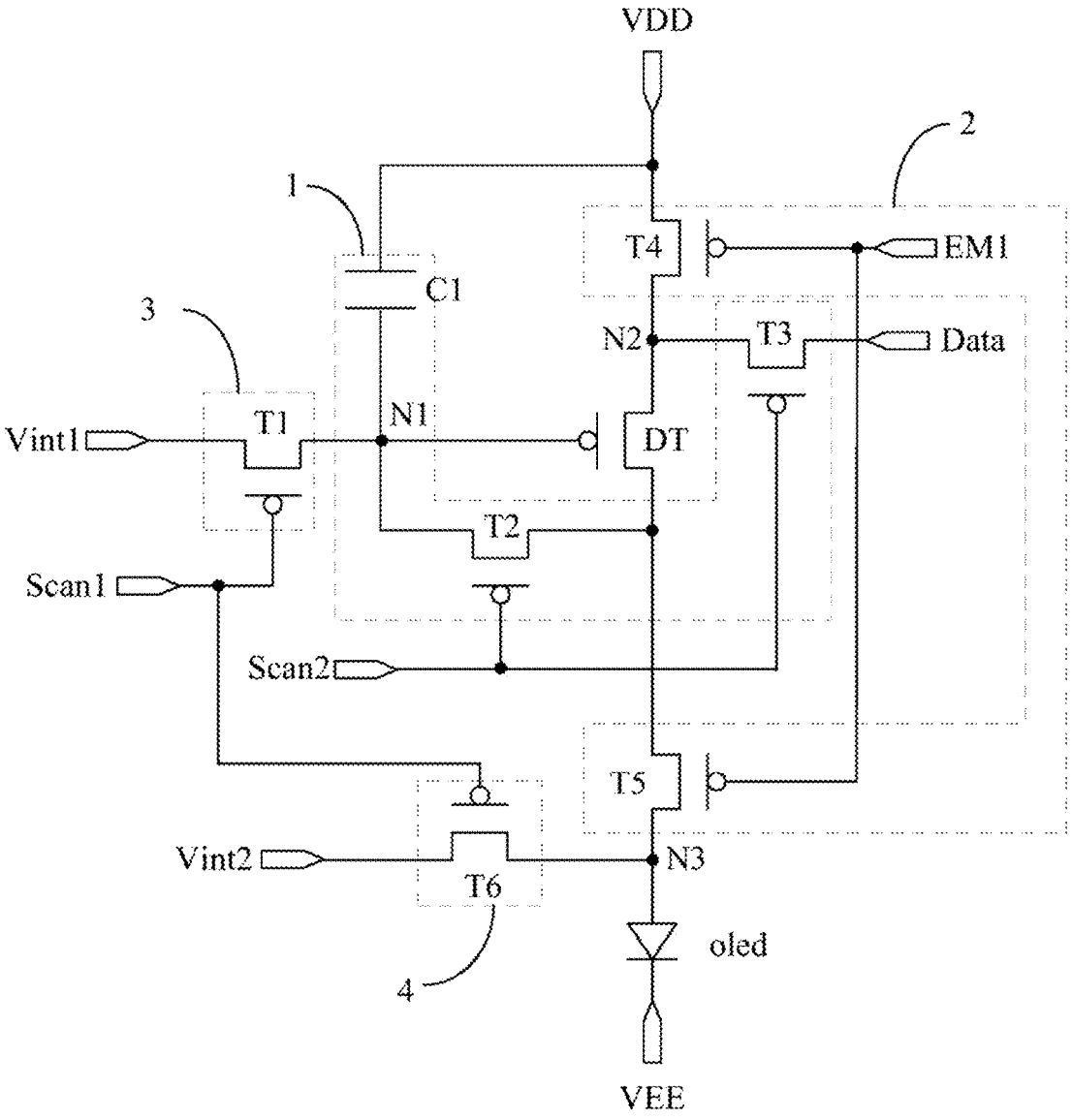
FIG. 7 is a sixth schematic structural diagram of the pixel circuit according to some embodiments of the disclosure.

Optionally, in the pixel circuit according to some embodiments of the disclosure, as illustrated in FIG. 7, the first light-emission control terminal EM1 is the same signal terminal as the second light-emission control terminal EM2, so that a signal terminal can be dispensed with to thereby reduce the amount of wiring.

Figure 8:
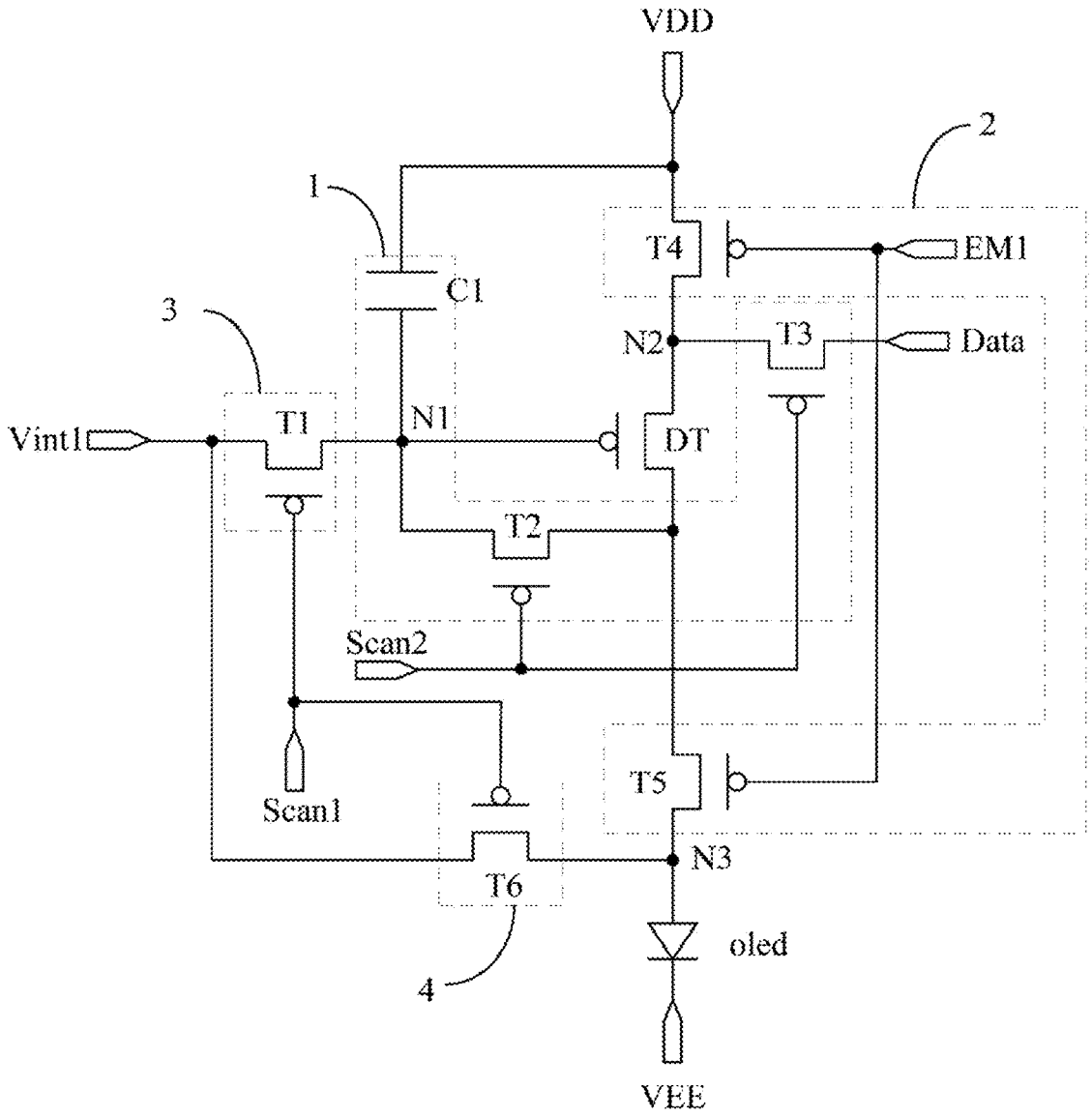
FIG. 8 is a seventh schematic structural diagram of the pixel circuit according to some embodiments of the disclosure.

Optionally, in the pixel circuit according to the embodiment of the disclosure, as illustrated in FIG. 8, the first reset signal terminal Vint1 is the same signal terminal as the second reset signal terminal Vint2, so that a signal terminal can be dispensed with to thereby reduce the amount of wiring.

Optionally, in the pixel circuit according to the embodiment of the disclosure, the node reset sub-circuit 3 is further configured to reset the gate of the driver transistor DT in response to the first scan signal terminal Scant in a second reset stage.

The second reset stage lies between the first reset stage and the data writing stage.

Figure 9:
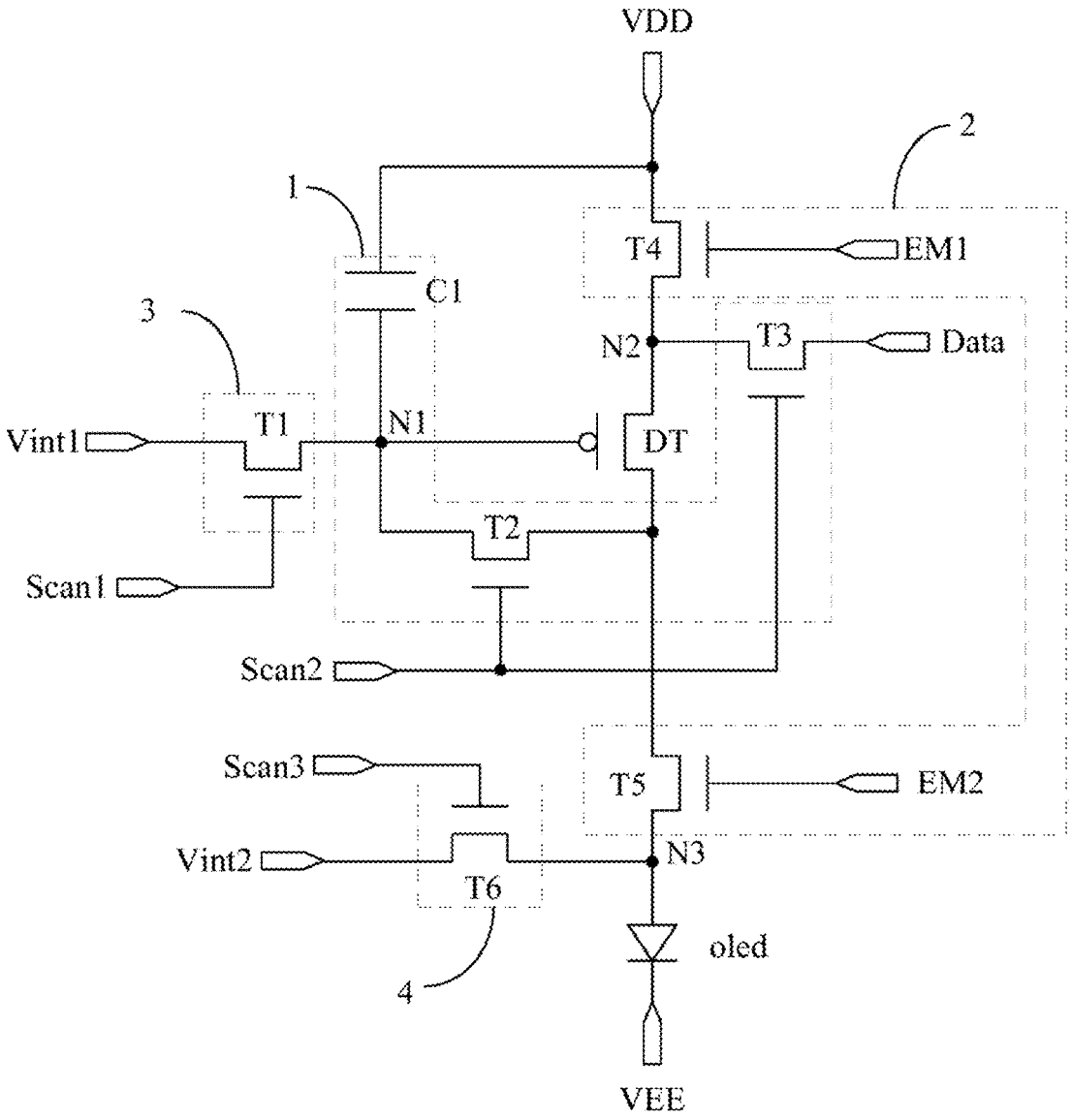
FIG. 9 is an eighth schematic structural diagram of the pixel circuit according to some embodiments of the disclosure.

Optionally, in order to make a fabrication process uniform, in the pixel circuit according to some embodiments of the disclosure, as illustrated in FIG. 4 to FIG. 8, all the switch transistors are P-type transistors; or as illustrated in FIG. 9, all the switch transistors are N-type transistors.

Optionally, in the pixel circuit according to some embodiments of the disclosure, an N-type transistor is switched on by a high-level signal, and switched off by a low-level signal; and a P-type transistor is switched on by a low-level signal, and switched off by a high-level signal.

Optionally, in the pixel circuit according to some embodiments of the disclosure, the first electrodes of the transistors can be sources, and the second electrodes thereof can be drains, or the first electrodes of the transistors can be drains, and the second electrodes thereof can be sources, although the embodiment of the disclosure will not be limited thereto.

Optionally, in the pixel circuit according to some embodiments of the disclosure, any switch transistor can be structured with dual gates in order to alleviate leakage current, although the embodiment of the disclosure will not be limited thereto.

In the pixel circuit according to some embodiments of the disclosure, the driver-transistor is a P-type transistor, but the driver transistor can alternatively be an N-type transistor, and the same design principle will be applicable thereto, without departing from the claimed scope of the disclosure.

In the pixel circuit according to some embodiments of the disclosure, the driver transistor and the switch transistors can be Thin Film Transistors (TFTs), or can be Metal Oxide Semiconductor Field-Effect Transistors (MOSFETs), although the embodiment of the disclosure will not be limited thereto. In a particular implementation, the first and second electrodes of these transistors can be interchanged in function dependent upon their different transistor types and input signals without being distinguished from each other.

Optionally, in the pixel circuit according to some embodiments of the disclosure, as illustrated in FIG. 4 to FIG. 9, the gate of the driver transistor DT is a first node N1, the first electrode of the driver transistor DT is a second node N2, and the second electrode of the driver transistor DT is a third node N3.

An operating process of the pixel circuit according to some embodiments of the disclosure will be described below in connection with a circuit timing diagram. In the following description, 1 represents a high level, and 0 represents a low level. It shall be noted that 1 and 0 are logic levels, and only intended to better illustrate the particular operating process according to the embodiment of the disclosure, but not to suggest any particular voltage values.

First Example

Figure 10A:
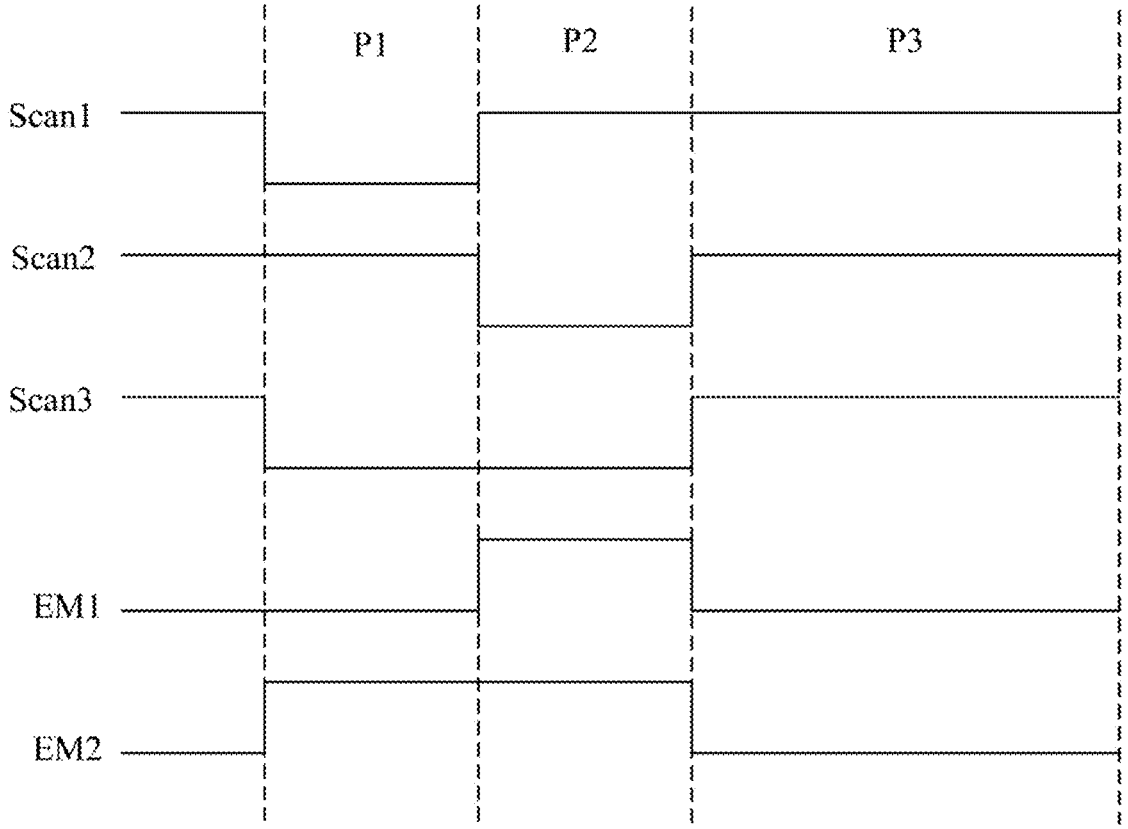
FIG. 10A is a first input timing diagram of the pixel circuit according to some embodiments of the disclosure.

Taking the pixel circuit as illustrated in FIG. 4 as an example, FIG. 10A illustrates an input-output timing diagram corresponding to the pixel circuit. Optionally, there are three selected stages P1, P2, and P3 in the input timing diagram as illustrated in FIG. 10A.

In the P1 stage (i.e., the first reset stage), Scan1=0, Scan2=1, Scan3=0, Emit1=0, and Emit2=1. The first switch transistor T1 is switched on to reset the gate of the driver transistor DT, where the potential of the first node N1 is Vint1. The fourth switch transistor T4 is switched on to reset the first electrode of the driver transistor DT, where the potential of the second node N1 is VDD. The sixth switch transistor T6 is switched on to reset the anode of the light-emitting diode oled, where the potential of the third node N3 is Vint2. The second switch transistor T2, the third switch transistor T3, and the fifth switch transistor T5 are switched off, and the light-emitting diode oled does not emit any light.

In the P2 stage (i.e., the data writing stage), Scan1=1, Scan2=0, Scan3=0, Emit1=1, and Emit2=1. The third switch transistor T3 is switched on to write the data signal into the first electrode of the driver transistor DT, where the potential of the second node N2 is Vdata, and the second switch transistor T2 is switched on to charge the potential of the first node N1 to Vdata−|Vth|. The sixth switch transistor T6 is switched on to reset the anode of the light-emitting diode oled, where the potential of the third node N3 is Vint2. The first switch transistor T1, the fourth switch transistor T4, and the fifth 5 are switched off, and the light-emitting diode oled does not emit any light.

In the P3 stage (i.e., the light emission stage), Scan1=1, Scan2=1, Scan3=1, Emit1=0, and Emit2=0.

The fourth switch transistor T4 is switched on to transmit the signal of the first voltage terminal VDD to the second node N2, where the potential of the second node N2 is VDD. At this time, the gate-source voltage of the driver transistor DT is Vsg=VDD−Vdata+|Vth|, and the drive current of the driver transistor DT is $I=K(Vsg-|Vth|)^2=K(VDD-Vdata)^2$; and the fifth switch transistor T5 is switched on so that the drive current of the driver transistor DT drives the light-emitting diode oled into operation to emit light. Since K is a structural parameter which has a stable value in the same structure and can be regarded as a constant. As can be apparent, the current flowing to the light-emitting diode oled has not been affected by the threshold voltage of the driver transistor DT, thus avoiding the driver transistor DT from being affected by the drifting threshold voltage so as to improve display non-uniformity of the display panel.

Furthermore, the fourth switch transistor T4 resets the first electrode of the driver transistor DT using the first voltage terminal VDD in the P1 stage, and the first switch transistor T1 resets the gate of the driver transistor DT, so that the gate-source voltage of the driver transistor DT is Vgs=Vint1−VDD which is a fixed value in the first reset stage for displaying each frame, thus addressing the problem of an afterimage.

It shall be noted in the pixel circuit according to the embodiment of the disclosure, the duration of the first reset stage can be nH, where n is greater than or equal to 1, and 1H is equal to the duration of the data writing stage.

Second Example

Figure 10B:
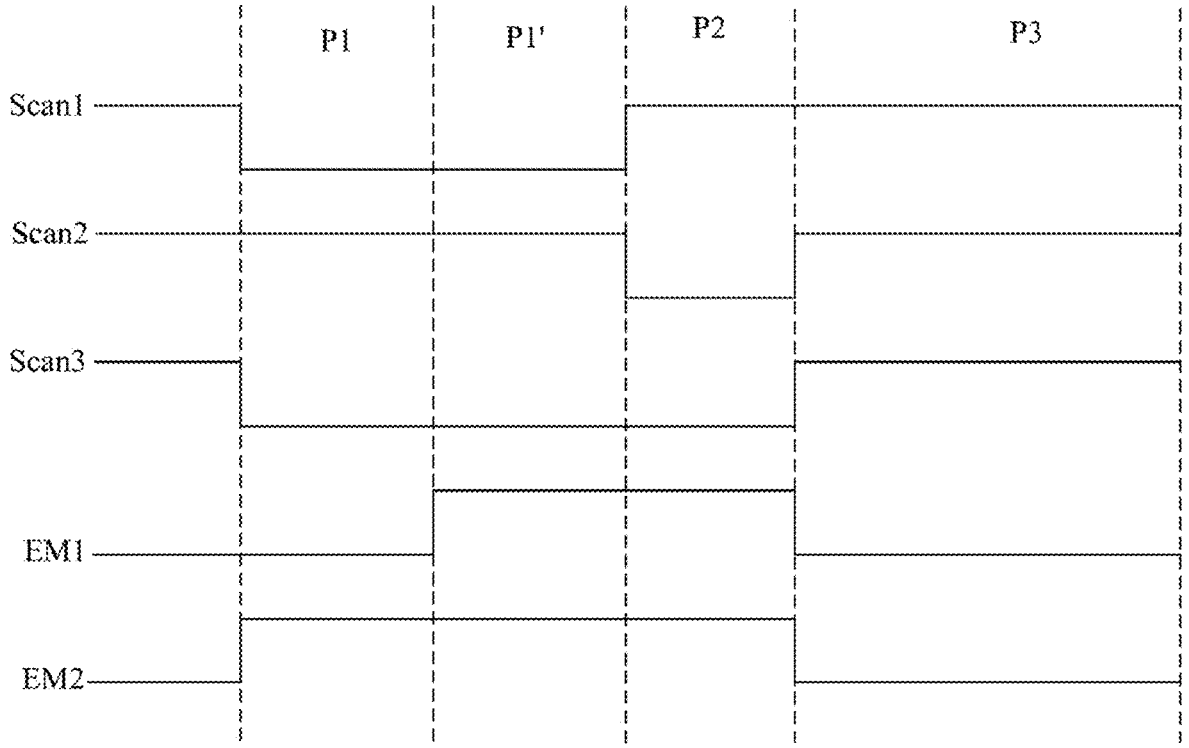
FIG. 10B is a second input timing diagram of the pixel circuit according to some embodiments of the disclosure.

Optionally, since the signal is delayed, in order to avoid the fourth switch transistor T4 from writing the data signal into the second node N2 before it is switched off, the second reset stage may be further arrangement between the first reset stage and the data writing stage, and FIG. 10B illustrates an input-output timing diagram corresponding to the pixel circuit as illustrated in FIG. 4. Optionally, there are four stages P1, P1', P2, and P3 in the input timing diagram as illustrated in FIG. 10A.

Operating process in the stages P1, P2, and P3 are the same as those in the stages P1, P2, and P3 in the first example, so a repeated description thereof will be omitted here. The P1' stage, i.e., the second reset stage, will be introduced below in details.

In the P1' stage (i.e., the second reset stage), Scan1=0, Scan2=1, Scan3=0, Emit1=1, and Emit2=1. The first switch transistor T1 is switched on to reset the gate of the driver transistor DT, where the potential of the first node N1 is Vint1. The sixth switch transistor T6 is switched on to reset the anode of the light-emitting diode oled, where the potential of the third node N3 is Vint2. The second switch transistor T2, the third switch transistor T3, the fourth switch transistor T4, and the fifth switch transistor T5 are switched off, and the light-emitting diode oled does not emit any light.

Third Example

Figure 10C:
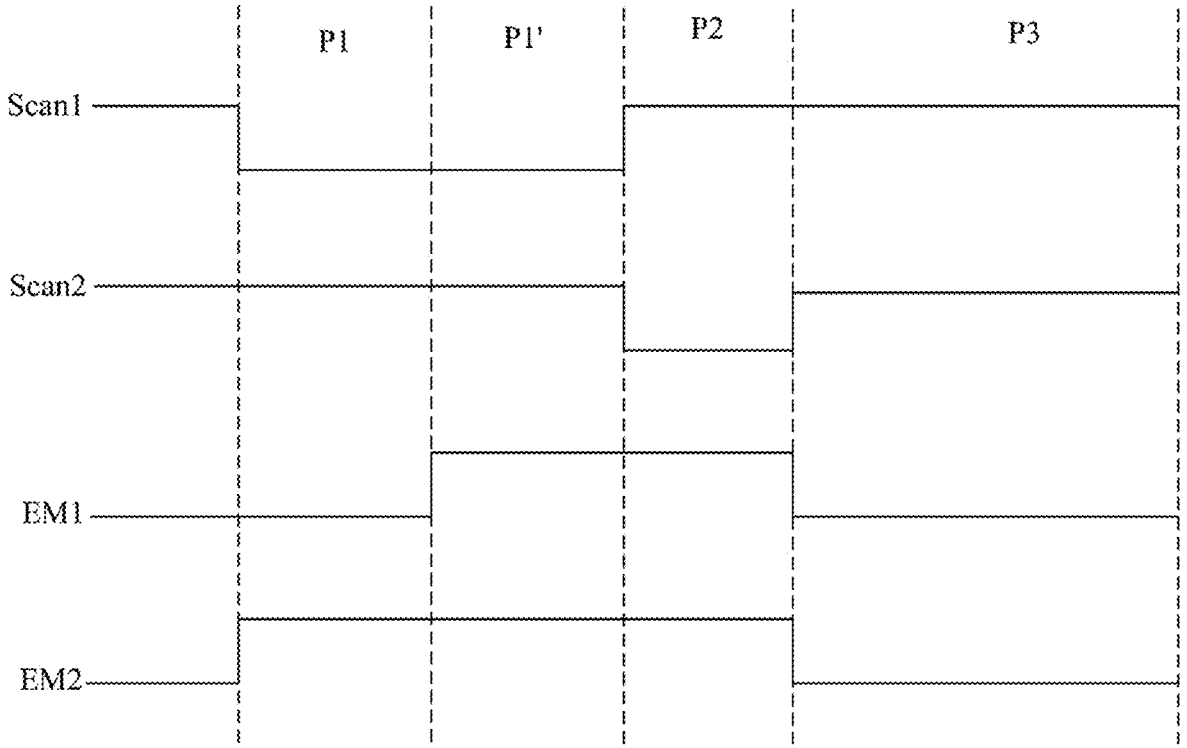
FIG. 10C is a third input timing diagram of the pixel circuit according to some embodiments of the disclosure.

Optionally, in order to dispense with a signal terminal, the third scan signal terminal can be the same signal terminal as the first scan signal terminal. Taking the pixel circuit as illustrated in FIG. 5 as an example, FIG. 10C illustrates an input-output timing diagram corresponding to the pixel circuit as illustrated in FIG. 5. Optionally, there are four stages P1, P1', P2, and P3 in the input timing diagram as illustrated in FIG. 10C.

Optionally, the operating states of the other switch transistors than the sixth switch transistor T6 in the second example are the same as those in the second example. The sixth switch transistor T6 in the second example is switched on throughout the three stages P1, P1', and P2, and the sixth switch transistor T6 in this example is switched on in only the P1 and P1' stages.

Fourth Example

Optionally, in order to dispense with a signal terminal, the third scan signal terminal can be the same signal terminal as the second scan signal terminal. Taking the pixel circuit as illustrated in FIG. 6 as an example, FIG. 10C illustrates an input-output timing diagram corresponding to the pixel circuit as illustrated in FIG. 6. Optionally, there are four stages P1, P1', P2, and P3 in the input timing diagram as illustrated in FIG. 10C.

Optionally, the operating states of the other switch transistors than the sixth switch transistor T6 in the second example are the same as those in the second example. The sixth switch transistor T6 in the second example is switched on throughout the three stages P1, P1', and P2, and the sixth switch transistor T6 in this example is switched on in only the P2 stage.

Fifth Example

Optionally, in order to dispense with a signal terminal, the first light-emission control terminal can be the same signal terminal as the second light-emission control terminal, but if the first light-emission control terminal is the same as the second light-emission control terminal, then the fifth switch transistor will be switched on, so in order to avoid the light-emitting diode from emitting light for a while because the fifth switch transistor is switched on, the sixth switch transistor shall be switched on in the first reset stage to reset the anode of the light-emitting diode so s to avoid the light-emitting diode from emitting light. In view of this, the third scan signal terminal is the same signal terminal as the first scan signal terminal, so that as many as signal terminals can be dispensed with, but also the light-emitting diode can be avoided from being turned on in the first reset stage.

Figure 10D:
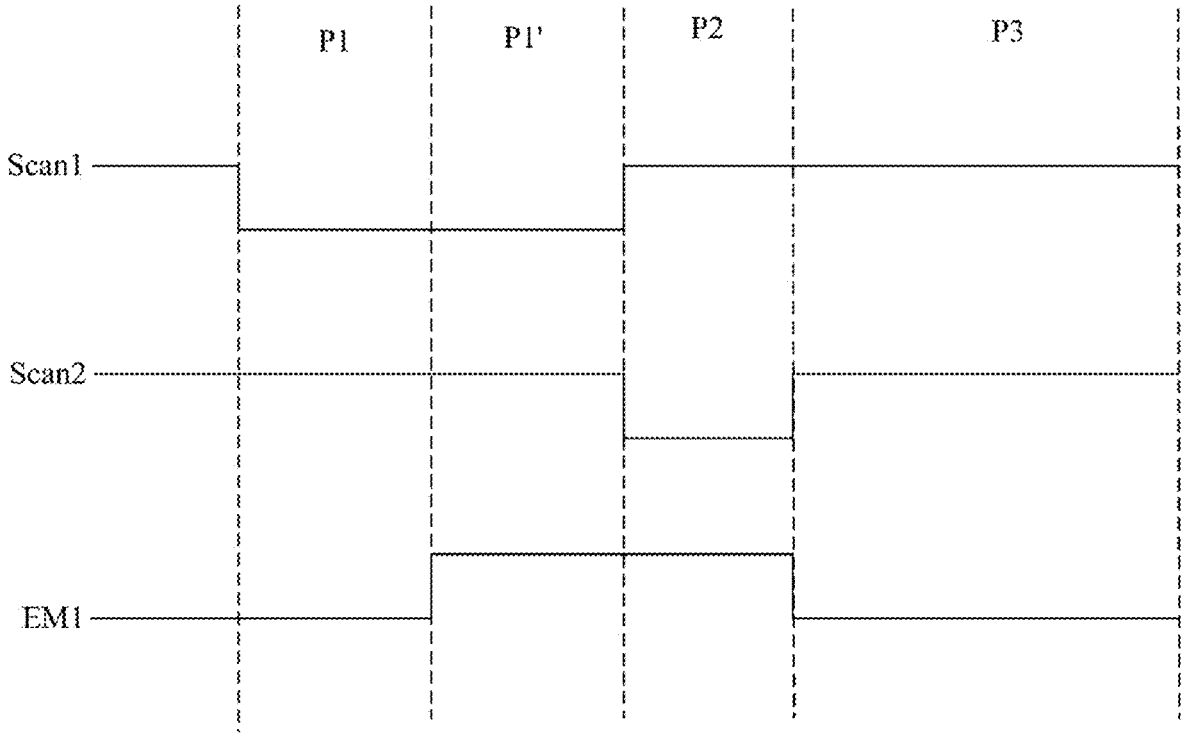
FIG. 10D is a fourth input timing diagram of the pixel circuit according to some embodiments of the disclosure.

Optionally, taking the pixel circuit as illustrated in FIG. 7 as an example, FIG. 10D illustrates an input-output timing diagram corresponding to the pixel circuit. Optionally, there are four stages P1, P1', P2, and P3 in the input timing diagram as illustrated in FIG. 10D.

Optionally, the operating states of the other switch transistors than the fifth switch transistor T5 in the third example are the same as those in the third example. The fifth switch transistor T5 in the third example is switched on in only the P3 stage, and the fifth switch transistor T5 in this example is switched on in both of the P1 and P3 stages.

The first to fifth examples have been described above, where all the switch transistors are P-type transistors, for example, and the following example will be described below, where all the switch transistors are N-type transistors.

Sixth Example

Figure 10E:
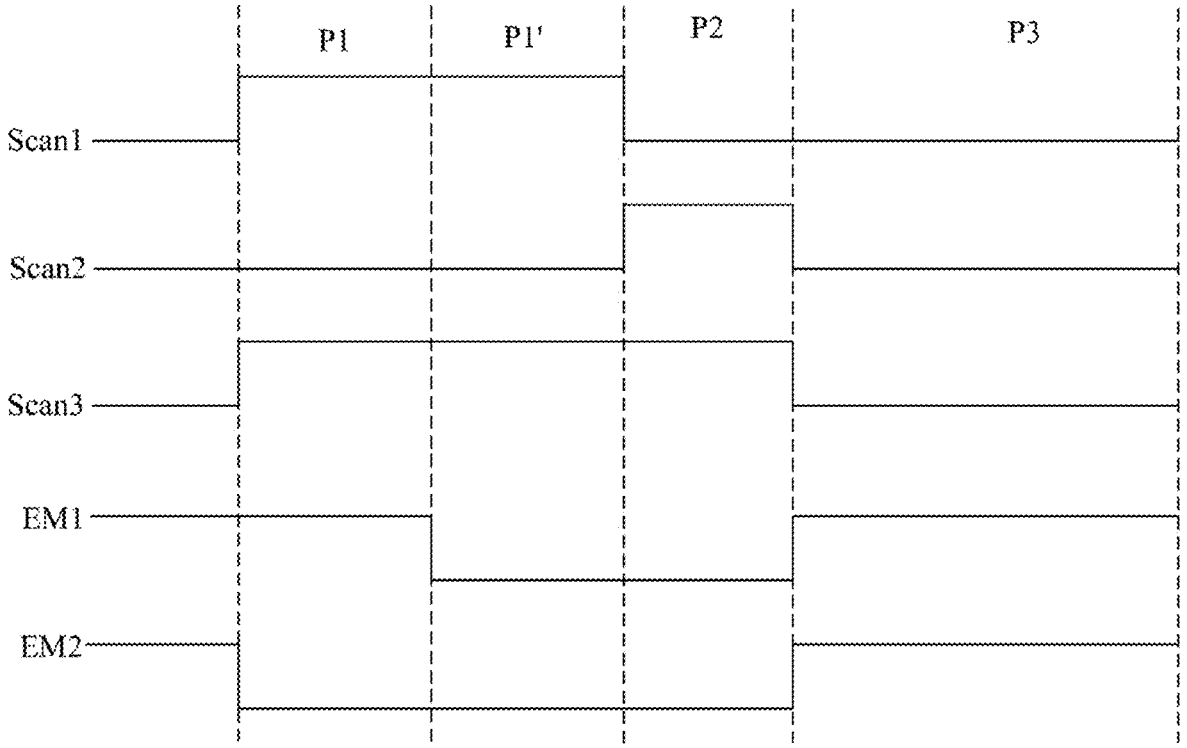
FIG. 10E is a fifth input timing diagram of the pixel circuit according to some embodiments of the disclosure.

Taking the pixel circuit as illustrated in FIG. 9 as an example, FIG. 10E illustrates an input-output timing diagram corresponding to the pixel circuit. Optionally, there are four stages P1, P1', P2, and P3 in the input timing diagram as illustrated in FIG. 10E.

In the P1 stage (i.e., the first reset stage), Scan1=1, Scan2=0, Scan3=1, Emit1=1, and Emit2=0. The first switch transistor T1 is switched on to reset the gate of the driver transistor DT, where the potential of the first node N1 is Vint1. The fourth switch transistor T4 is switched on to reset the first electrode of the driver transistor DT, where the potential of the second node N1 is VDD. The sixth switch transistor T6 is switched on to reset the anode of the light-emitting diode oled, where the potential of the third node N3 is Vint2. The second switch transistor T2, the third switch transistor T3, and the fifth switch transistor T5 are switched off, and the light-emitting diode oled does not emit any light.

In the P1' stage (i.e., the second reset stage), Scan1=1, Scan2=0, Scan3=1, Emit1=0, and Emit2=0. The first switch transistor T1 is switched on to reset the gate of the driver transistor DT, where the potential of the first node N1 is Vint1. The sixth switch transistor T6 is switched on to reset the anode of the light-emitting diode oled, where the potential of the third node N3 is Vint2. The second switch transistor T2, the third switch transistor T3, the fourth switch transistor T4, and the fifth switch transistor T5 are switched off, and the light-emitting diode oled does not emit any light.

In the P2 stage (i.e., the data writing stage), Scan1=0, Scan2=1, Scan3=1, Emit1=0, and Emit2=0. The third switch transistor T3 is switched on to write the data signal into the first electrode of the driver transistor DT, where the potential of the second node N2 is Vdata, and the second switch transistor T2 is switched on to charge the potential of the first node N1 to Vdata−|Vth|. The sixth switch transistor T6 is switched on to reset the anode of the light-emitting diode oled, where the potential of the third node N3 is Vint2. The first switch transistor T1, the fourth switch transistor T4, and the fifth 5 are switched off, and the light-emitting diode oled does not emit any light.

In the P3 stage (i.e., the light emission stage), Scan1=0, Scan2=0, Scan3=0, Emit1=1, and Emit2=1.

The fourth switch transistor T4 is switched on to transmit the signal of the first voltage terminal VDD to the second node N2, where the potential of the second node N2 is VDD. At this time, the gate-source voltage of the driver transistor DT is Vsg=VDD−Vdata+|Vth|, and the drive current of the driver transistor DT is $I=K(Vsg-|Vth|)^2=K(VDD-Vdata)^2$; and the fifth switch transistor T5 is switched on so that the drive current of the driver transistor DT drives the light-emitting diode oled into operation to emit light. Since K is a structural parameter which has a stable value in the same structure and can be regarded as a constant. As can be apparent, the current flowing to the light-emitting diode oled has not been affected by the threshold voltage of the driver transistor DT, thus avoiding the driver transistor DT from being affected by the drifting threshold voltage so as to improve display non-uniformity of the display panel.

Furthermore, the fourth switch transistor T4 resets the first electrode of the driver transistor DT using the first voltage terminal VDD in the first reset stage, and the first switch transistor T1 resets the gate of the driver transistor DT, so that the gate-source voltage of the driver transistor DT is Vgs=Vint1−VDD which is a fixed value in the first reset stage for displaying each frame, thus addressing the problem of an afterimage.

In the pixel circuit above according to some embodiments of the disclosure, for example, while the image as illustrated in FIG. 1A is being lightened, the gate-source voltage Vgs of the driver transistor in the pixel circuit at a white position is represented as V(255), and if the image is to be switched to the grayscale L128, then firstly the gate-source voltage Vgs of the driver transistor in the pixel circuit at the white position will be reset to Vint1−VDD in the first reset stage, then the voltage V(128) will be written in the data writing stage, and the current flowing to the light-emitting diode through the driver transistor will be represented as Ids (255→RESET→) in the light emission stage.

The gate-source voltage Vgs of the driver transistor in the pixel circuit at a black position is represented as V(255), so firstly the gate-source voltage Vgs of the driver transistor in the pixel circuit at the black position is reset to Vint1−VDD in the first reset stage, then the voltage V(128) is written in the data writing stage, and the current flowing to the light-emitting diode through the driver transistor is represented as Ids(0→RESET→) in the light emission stage.

After the image in white and black is switched to the image at the L128 grayscale as illustrated in FIG. 1B, the difference between Ids(255→RESET→) and Ids(0→RESET→) is so insignificant that there is almost difference between the brightness of the light-emitting diode at the white and black positions, thus addressing an afterimage.

Based upon the same inventive idea, an embodiment of the disclosure further provides a display panel including the pixel circuits according to any one of the embodiments above of the disclosure. Since the display panel addresses the problem under a similar principle to the pixel circuit above, reference can be made to the implementation of the pixel circuit above for an implementation of the display panel, and a repeated description thereof will be omitted here.

Based upon the same inventive idea, an embodiment of the disclosure further provides a display device including the display panel according to the embodiment above of the disclosure. The display device can be a mobile phone, or can be a tablet computer, a TV set, a monitor, a notebook computer, a digital photo frame, a navigator, or any other product or component with a display function. Since the display device addresses the problem under a similar principle to the display panel above, reference can be made to the implementation of the display panel above for an implementation of the display device, and a repeated description thereof will be omitted here.

Based upon the same inventive idea, an embodiment of the disclosure further provides a method for driving the pixel circuit according to any one of the embodiments above of the disclosure. Since the driving method addresses the problem under a similar principle to the pixel circuit above, reference can be made to the implementation of the pixel circuit above for an implementation of the driving method, and a repeated description thereof will be omitted here.

Figure 11:
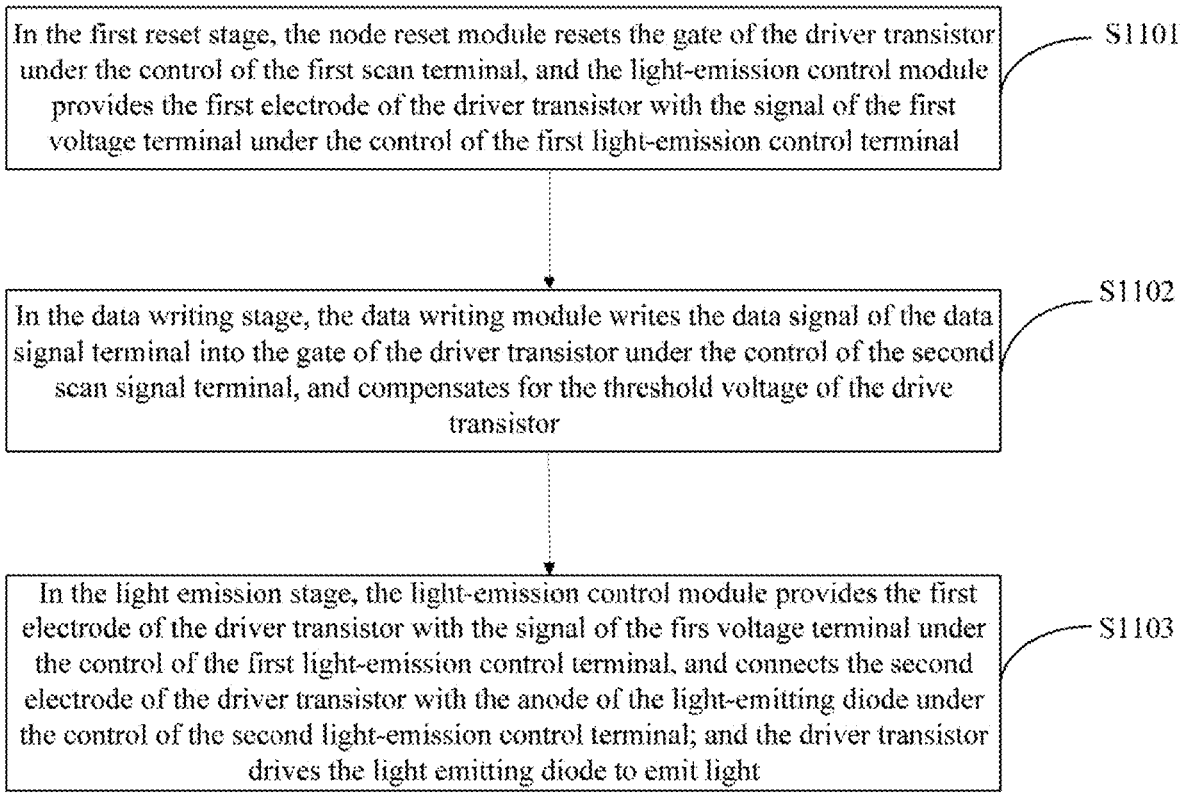
FIG. 11 is a first schematic flow chart of a method for driving a pixel circuit according to some embodiments of the disclosure.

Optionally, as illustrated in FIG. 11, a method for driving a pixel circuit according to an embodiment of the disclosure includes the following steps.

In the step S1101, in the first reset stage, the node reset sub-circuit resets the gate of the driver transistor under the control of the first scan terminal, and the light-emission control sub-circuit provides the first electrode of the driver transistor with the signal of the first voltage terminal under the control of the first light-emission control terminal.

In the step S1102, in the data writing stage, the data writing sub-circuit writes the data signal of the data signal terminal into the gate of the driver transistor under the control of the second scan signal terminal, and compensates for the threshold voltage of the drive transistor.

In the step S1103, in the light emission stage, the light-emission control sub-circuit provides the first electrode of the driver transistor with the signal of the first voltage terminal under the control of the first light-emission control terminal, and connects the second electrode of the driver transistor with the anode of the light-emitting diode under the control of the second light-emission control terminal; and the driver transistor drives the light emitting diode to emit light.

Optionally, when the pixel circuit includes the anode reset sub-circuit, the driving method according to some embodiments of the disclosure further includes:

Before the light emission stage, the anode reset sub-circuit resets the anode of the light emitting diode under the control of the third scan signal terminal.

Figure 12:
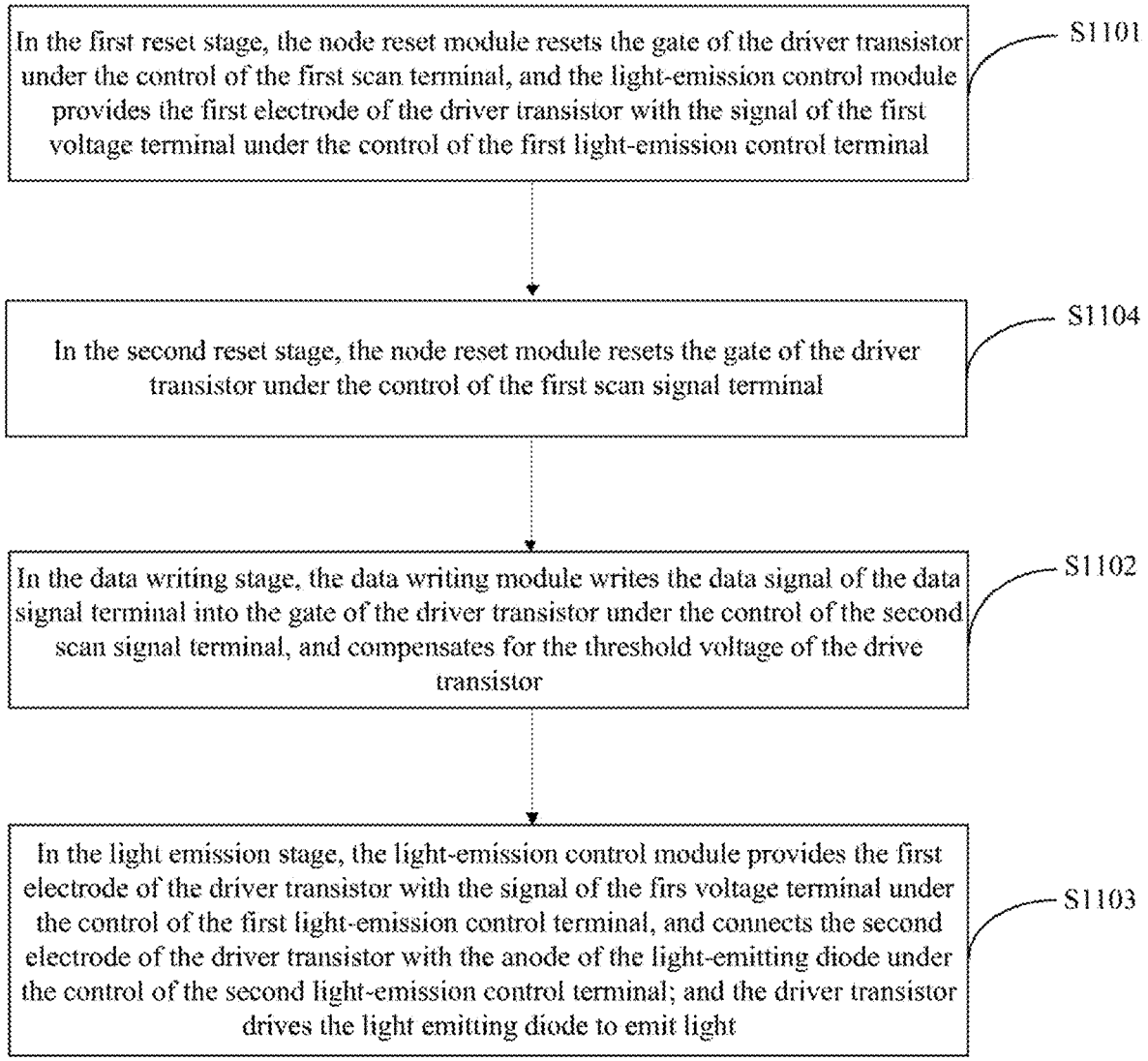
FIG. 12 is a second schematic flow chart of a method for driving a pixel circuit according to some embodiments of the disclosure.

Optionally, in the driving method according to some embodiments of the disclosure, as illustrated in FIG. 12, between the first reset stage of S1101, and the data writing stage of S1102, the method further includes the second reset stage of S1104.

In the step S1104, in the second reset stage, the node reset sub-circuit resets the gate of the driver transistor under the control of the first scan signal terminal. Reference can be made to the second to fifth examples for a particular operating principle thereof, and reference can be made to FIG. 10B to FIG. 10D for timing thereof, so a repeated description thereof will be omitted here.

In the method for driving a pixel circuit according to some embodiments of the disclosure, the light-emission control sub-circuit resets the first electrode of the driver transistor using the first voltage terminal in the first reset stage, and the reset sub-circuit resets the gate of the driver transistor in the first reset stage, so that gate-source voltage of the driver transistor can be a constant value without being affected by a last signal or image, thus addressing the problem of an afterimage.

Optionally, when the third scan signal terminal is the same terminal as the first scan signal terminal, in the driving method according to some embodiments of the disclosure, between the first reset stage and the second reset stage, the method further includes: the anode reset sub-circuit resets the anode of the light-emitting diode under the control of the third scan signal terminal. Reference can be made to the third and fifth examples for a particular operating principle thereof, and reference can be made to FIG. 10C and FIG. 10D for timing thereof, so a repeated description thereof will be omitted here.

Optionally, when the third scan signal terminal is the same terminal as the second scan signal terminal, in the driving method according to some embodiments of the disclosure, in the data writing stage, the method further includes: the anode reset sub-circuit resets the anode of the light-emitting diode under the control of the third scan signal terminal. Reference can be made to the fourth example for a particular operating principle thereof, and reference can be made to FIG. 10C for timing thereof, so a repeated description thereof will be omitted here.

Optionally, when the first light-emission control terminal is the same signal terminal as the second light-emission control terminal, in the driving method according to the embodiment of the disclosure, in the first reset stage, the method further includes:

the light-emission control sub-circuit connects the second electrode of the driver transistor with the anode of the light-emitting diode under the control of the second light-emission control terminal. Reference can be made to the fifth example for a particular operating principle thereof, and reference can be made to FIG. 10D for timing thereof, so a repeated description thereof will be omitted here.

With the pixel circuit, the method for driving the same, the display panel, and the display device according to embodiments of the disclosure, in the pixel circuit, the node reset sub-circuit resets the gate of the driver transistor in the first reset stage, the data writing sub-circuit writes the data signal, and compensates for the drifting threshold voltage of the driver transistor, in the data writing stage, and the light-emission control sub-circuit connects the first voltage terminal with the light-emitting diode in the light emission stage, thus addressing the problem of display non-uniformity arising from the drifting threshold voltage of the driver transistor due to a process factor, and aging of the transistor, through internal compensation. Furthermore the light-emission control sub-circuit resets the first electrode of the driver transistor using the first voltage terminal in the first reset stage, and the reset sub-circuit resets the gate of the driver transistor in the first reset stage, so that gate-source voltage of the driver transistor can be a constant value without being affected by a last signal or image, thus addressing the problem of an afterimage.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A pixel circuit, comprising: a driver transistor, a data writing sub-circuit, a light-emission control sub-circuit, a node reset sub-circuit, and a light-emitting diode, wherein:

the node reset sub-circuit is configured to reset a gate of the driver transistor in response to a first scan signal terminal in a first reset stage;

the data writing sub-circuit is configured to write a data signal of a data signal terminal into the gate of the driver transistor, and to compensate threshold voltage of the driver transistor, in response to a second scan signal terminal in a data writing stage;

the light-emission control sub-circuit is configured to provide a first electrode of the driver transistor with a signal of a first voltage terminal in response to a first light-emission control terminal in the first reset stage and a light emission stage; and to connect a second electrode of the driver transistor with an anode of the light-emitting diode in response to a second light-emission control terminal in a light emission stage;

the driver transistor is configured to drive current according to the data signal to drive the light-emitting diode to emit light; and the first reset stage, the data writing stage, and the light emission stage are consecutive periods of time;

wherein the data writing sub-circuit comprises a second switch transistor, a third switch transistor, and a first capacitor, wherein:

the second switch transistor has a gate connected with the second scan signal terminal, a first electrode connected with the gate of the driver transistor, and a second electrode connected with the second electrode of the driver transistor;

the third switch transistor has a gate connected with the second scan signal terminal, a first electrode connected with the data signal terminal, and a second electrode connected with the first electrode of the driver transistor; and the first capacitor has one terminal connected with the gate of the driver transistor, and another terminal connected with the first voltage terminal.

2. The pixel circuit according to claim 1, wherein the node reset sub-circuit comprises a first switch transistor, wherein:

the first switch transistor has a gate connected with the first scan signal terminal, a first electrode connected with a first reset signal terminal, and a second electrode connected with the gate of the driver transistor.

3. The pixel circuit according to claim 1, wherein the light-emission control sub-circuit comprises a fourth switch transistor and a fifth switch transistor, wherein:

the fourth switch transistor has a gate connected with the first light-emission control terminal, a first electrode connected with the first voltage terminal, and a second electrode connected with the first electrode of the driver transistor; and the fifth switch transistor has a gate connected with the second light-emission control terminal, a first electrode connected with the first electrode of the driver transistor, and a second electrode connected with the anode of the light-emitting diode.

4. The pixel circuit according to claim 1, further comprises an anode reset sub-circuit, wherein:

the anode reset sub-circuit is configured to reset the anode of the light-emitting diode in response to a third scan signal terminal before the light emission stage.

5. The pixel circuit according to claim 4, wherein the anode reset sub-circuit comprises a sixth switch transistor, wherein:

the sixth switch transistor has a gate connected with the third scan signal terminal, a first electrode connected with a second reset signal terminal, and a second electrode with the anode of the light-emitting diode.

6. The pixel circuit according to claim 5, wherein the first scan signal terminal is configured to be reused as the third scan signal terminal, or the second scan signal terminal is configured to be reused as the third scan signal terminal.

7. The pixel circuit according to claim 1, wherein the first light-emission control terminal is configured to be reused as the second light-emission control terminal.

8. The pixel circuit according to claim 1, wherein the node reset sub-circuit is further configured to reset the gate of the driver transistor in response to the first scan signal terminal in a second reset stage, wherein:

the second reset stage lies between the first reset stage and the data writing stage.

9. A display panel, comprising the pixel circuit according to claim 1.

10. A display device, comprising the display panel according to claim 9.

11. A method for driving the pixel circuit according to claim 1, the method comprising:

in the first reset stage, resetting, by the node reset sub-circuit, the gate of the driver transistor under a control of the first scan terminal, and providing, by the light-emission control sub-circuit, the first electrode of the driver transistor with the signal of the first voltage terminal under a control of the first light-emission control terminal;

in the data writing stage, writing, by the data writing sub-circuit, the data signal of the data signal terminal into the gate of the driver transistor under a control of the second scan signal terminal, and compensating for the threshold voltage of the drive transistor; and in the light emission stage, providing, by the light-emission control sub-circuit, the first electrode of the driver transistor with the signal of the first voltage terminal under a control of the first light-emission control terminal, and connecting the second electrode of the driver transistor with the anode of the light-emitting diode under a control of the second light-emission control terminal; and driving, by the driver transistor, the light emitting diode to emit light.

12. The driving method according to claim 11, wherein in response to that the pixel circuit comprises an anode reset sub-circuit, the driving method further comprises:

before the light emission stage, resetting, by the anode reset sub-circuit, the anode of the light emitting diode under a control of a third scan signal terminal.

13. The driving method according to claim 11, wherein between the first reset stage and the data writing stage, the method further comprises a second reset stage, wherein:

in the second reset stage, resetting, by the node reset sub-circuit, the gate of the driver transistor under a control of the first scan signal terminal.

14. The driving method according to claim 13, wherein in response to that the third scan signal terminal and the first scan signal terminal are same terminal, between the first reset stage and the second reset stage, the method further comprises:

resetting, by the anode reset sub-circuit, the anode of the light-emitting diode under a control of the third scan signal terminal; and in response to that the third scan signal terminal and the second scan signal terminal are same terminal, in the data writing stage, the method further comprises: resetting, by the anode reset sub-circuit, the anode of the light-emitting diode under a control of the third scan signal terminal.

15. The driving method according to claim 11, wherein in response to that the first light-emission control terminal and the second light-emission control terminal are same signal terminal, in the first reset stage, the method further comprises:

connecting, by the light-emission control sub-circuit, the second electrode of the driver transistor with the anode of the light-emitting diode under a control of the second light-emission control terminal.

* * * * *